US010779105B1

(12) United States Patent
Clark et al.

(10) Patent No.: US 10,779,105 B1
(45) Date of Patent: Sep. 15, 2020

(54) SENDING NOTIFICATION AND MULTI-CHANNEL AUDIO OVER CHANNEL LIMITED LINK FOR INDEPENDENT GAIN CONTROL

(71) Applicant: Apple Inc., Cupertino, CA (US)

(72) Inventors: Brian D. Clark, San Jose, CA (US); Baptiste P. Paquier, Saratoga, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/428,766

(22) Filed: May 31, 2019

(51) Int. Cl.
*H04S 7/00* (2006.01)
*H04S 3/00* (2006.01)
*G10L 19/008* (2013.01)

(52) U.S. Cl.
CPC ..... *H04S 7/30* (2013.01); *G10L 19/008* (2013.01); *H04S 3/008* (2013.01); *H04S 2400/01* (2013.01); *H04S 2400/13* (2013.01)

(58) Field of Classification Search
CPC ..... H04S 7/30; H04S 3/008; H04S 2400/01; H04S 2400/13; G10L 19/008
USPC ..... 381/23
See application file for complete search history.

(56) References Cited

U.S. PATENT DOCUMENTS 6,148,086 A 11/2000 Ciullo et al.
8,190,438 B1 * 5/2012 Nelissen ..... G10L 21/00 381/85
8,280,744 B2 10/2012 Hellmuth et al.
9,398,620 B1 7/2016 Lazzeroni et al.
2003/0144833 A1 * 7/2003 Glatt ..... H04N 21/235 704/200.1
2007/0286426 A1 * 12/2007 Xiang ..... H04M 1/6016 381/17
2008/0144858 A1 * 6/2008 Khawand ..... H04M 19/04 381/99
2009/0003612 A1 1/2009 Herre et al.
2010/0075606 A1 * 3/2010 Hargreaves ..... H04M 1/6066 455/41.3

(Continued)

OTHER PUBLICATIONS

Brian Florian and Stacey Spears, Product Review—Dolby Surround Pro Logic II—The Technology and the Sound—Mar. 2001 <https://hometheaterhifi.com/volume_8_1/dolby-prologic2-3-2001.html>.

*Primary Examiner* — David L Ton
(74) *Attorney, Agent, or Firm* — Womble Bond Dickinson (US) LLP

(57) ABSTRACT

A system and method to encode and decode multiple audio signals to provide independent control of the audio signals is provided. A host device may encode the audio signals to enable a complete separation of the constituent audio signals when the mixed stream is decoded on a playback device. The gains of the audio signals may be independently controlled before they are mixed to increase the intelligibility of one audio signal relative to another audio signal at the playback device. The ability to separate the constituent audio signals from the mixed signals at the playback device allows the processing operations performed on the constituent audio signals and the associated path latencies to be independently chosen. In addition, in applications where the mixed stream is transmitted from a single host device to multiple playback devices, the constituent audio signals may be selectively masked on a playback device to increase user privacy.

20 Claims, 5 Drawing Sheets

(56) References Cited

U.S. PATENT DOCUMENTS

| | | | | |
|---|---|---|---|---|
| 2011/0054647 | A1* | 3/2011 | Chipchase | H04M 3/53366 700/94 |
| 2011/0066941 | A1* | 3/2011 | Chipchase | G06F 3/165 715/716 |
| 2015/0235645 | A1* | 8/2015 | Hooks | G10L 19/008 704/500 |
| 2018/0220249 | A1* | 8/2018 | Aoki | H04S 3/008 |
| 2018/0307460 | A1* | 10/2018 | Barton | H04N 21/439 |

* cited by examiner

SENDING NOTIFICATION AND MULTI-CHANNEL AUDIO OVER CHANNEL LIMITED LINK FOR INDEPENDENT GAIN CONTROL

FIELD

This disclosure relates to the field of systems for communicating multiple streams of audio signals; and more specifically, to processing systems designed to encode and mix multiple streams of audio signals for transmission over a channel limited link, and processing systems designed to decode and separate a received mixed audio signal into multiple streams to enable independent control of the streams. Other aspects are also described.

BACKGROUND

When playing music, carrying on a telephone call, or listening to other audio content using a smartphone or other devices, another audio stream may "barge-in." For example, a playback of stereo music may be interrupted by a response from a virtual assistant, or by other types of audio notifications or alerts received from a server or generated by the smartphone. It is desirable for the smartphone to provide a more pleasing listening experience to a user when there are multiple audio streams.

SUMMARY

A user may listen to audio streams through an earphone that receives the audio streams via a wireless or wired link from an audio source device, such as a smartphone. The communication link between the smartphone and the earphone may be bandwidth or channel limited, such as in a BLUETOOTH link. As a result, the smartphone may mix audio streams with different bandwidth requirements, such as the stereo music encoded on two channels and the virtual assistant response encoded on one channel, into a mixed stream with a signal bandwidth that allows the mixed stream to be transmitted over the channel limited link to the earphone. In other situations, multiple earphones may receive the mixed stream from a single smartphone. It may be desirable to selectively enable the mixed stream on the earphones. To provide the desired intelligibility, audio quality and privacy, and to improve the overall listening experiences to consumers of audio signals communicated over a channel limited link, a flexible approach to encode and mix multiple audio signals into a mixed stream, and to decode and separate a received mixed stream into its constituent audio signals is performed.

When a user listens to a mixed stream of audio signals on a playback device communicated from a host device, such as an earphone linked to a smartphone, it is desirable for some characteristics of the constituent audio signals of the mixed stream, such as their gain, processing latency, or masking capability to be independently controlled. In one scenario, independent gain control of multiple audio signals in a mixed stream improves the intelligibility of one audio signal relative to another audio signal when playing the mixed stream. For example, when the playback of stereo music is interrupted by a virtual assistant response, the volume of the stereo music may fade to accommodate the audio of the virtual assistant response, in a process referred to as "barge-in" ducking. In another scenario, independent latency control of multiple audio signals allows an audio signal to bypass signal processing performed on another audio signal of the mixed stream. For example, the virtual assistant response may bypass noise suppression, frequency equalization, or other audio processing performed on stereo music to reduce the processing latency for the virtual assistant response with no effect on its audio quality. In another scenario, independent masking capability allows an audio signal of a mixed stream to be selectively masked to protect the privacy of a user. For example, when the host device transmits a mixed stream of music and virtual assistant response to multiple earphones, the virtual assistant response may be masked to all earphones except for the earphone from which a user solicited the virtual assistant response, in what is referred to as a splitter mode.

In one embodiment, to provide independent control of constituent audio signals of a mixed stream, the host device may encode the constituent audio signals to enable a complete separation of the constituent audio signals when the mixed stream is decoded on the playback device. The gains of the constituent audio signals may be independently controlled before they are mixed to increase the intelligibility of one audio signal relative to another audio signal at the playback device. The ability to separate the constituent audio signals from the mixed signals at the playback device allows the processing operations performed on the constituent audio signals and the path latencies associated with the processing operations to be independently chosen. In addition, in applications where the mixed stream is transmitted from a single host device to multiple playback devices, the constituent audio signals may be selectively masked on a playback device to increase user privacy.

A system and method for encoding and mixing audio signals at a host device into a mixed stream that allows the audio signals to be separated from the mixed stream at a host device is disclosed. The system performs a method that includes receiving a playback signal that is carried on a number of audio channels. The method includes determining whether a notification signal such as a virtual assistant response, an alert, an audio message, a voice response, or other types of speech signals are received. If the notification signal is received, the method converts the playback signal into a converted signal that is carried on a fewer number of audio channels. The method applies independent gains to the converted playback signal and the notification signal. The method mixes the converted playback signal and the notification signal that have been applied with independent gains into a mixed signal that allows the converted playback signal and the notification signal to be separated from the mixed signal at a playback device. The method switches between the mixed signal and the playback signal in response to determining whether the notification is received.

A system and method for decoding and separating constituent audio signals of a mixed stream to enable independent control of gain, latency, or masking capability of the constituent audio signals is disclosed. The system performs a method that includes receiving audio frames from a host device. The method determines whether the audio frames contain a playback signal or a mixed signal of a converted playback signal and a notification signal. The converted playback signal and the notification signal may have independent gains. If the audio frames contain the mixed signal, the method separates the mixed signal into the converted playback signal and the notification signal. The method processes the converted playback signal separately from the notification signal so the converted playback signal and the notification signal may have separate gains, processing latencies, or masking capabilities. The method mixes the processed converted playback signal and the processed notification signal to generate a remixed signal. The method switches between the playback signal and the remixed signal based on whether the audio frames contain the playback signal or the mixed signal.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
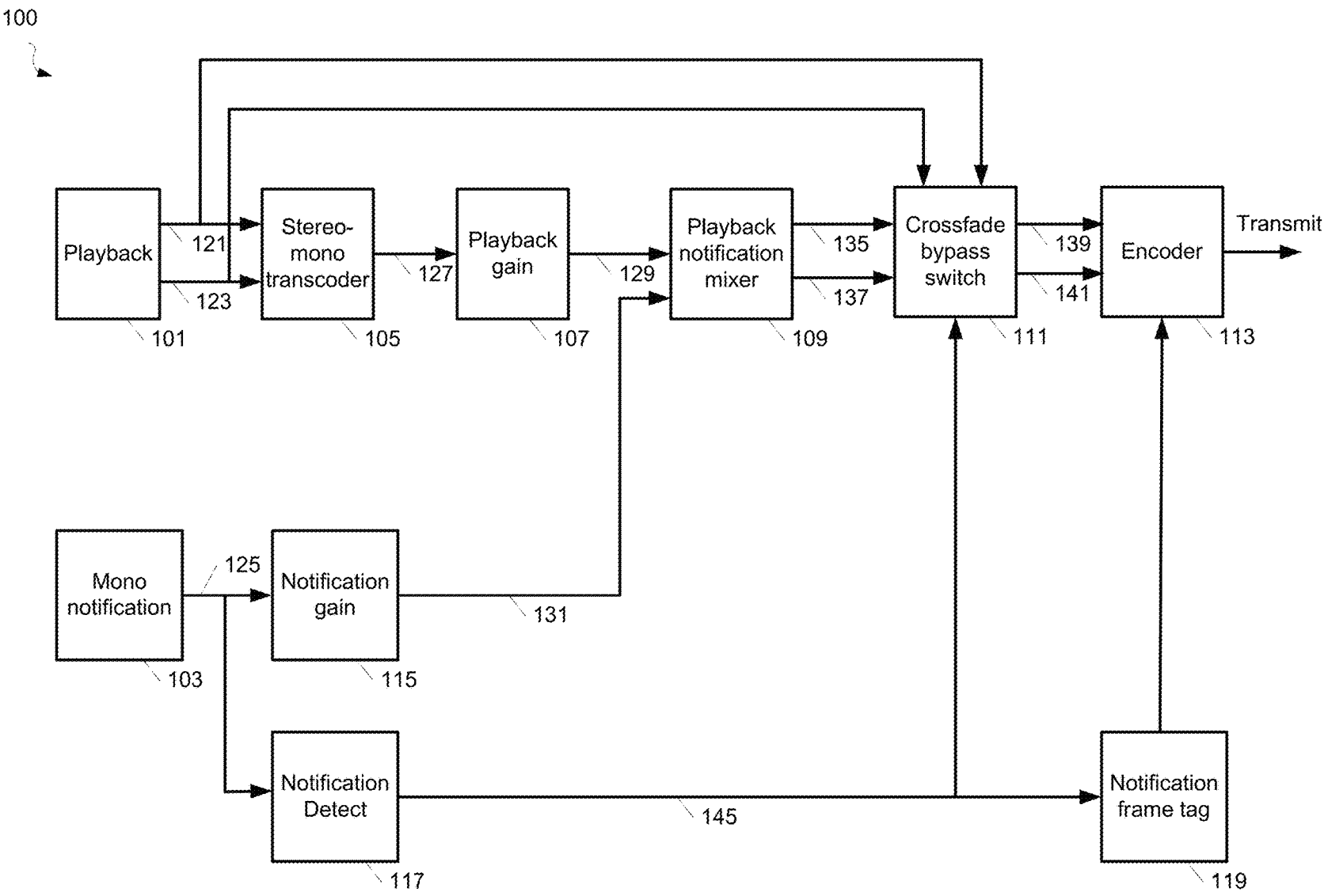
FIG. 1 is a block diagram of a mixed stream encoding system configured to encode and mix two audio signals into a mixed stream that allows the two audio signals to be decoded and separated from the mixed stream according to one embodiment of the disclosure.

When playing music or other audio stream on a smartphone or other devices, it is desirable for the smartphone not to abruptly end the music playback when a second audio stream, such as a virtual assistant response or a notification, is received. Instead, it is desirable for the smartphone to combine the two audio streams to provide a more pleasing listening experience to a user such as by fading the music and bringing the second stream to the foreground. To improve the intelligibility of the second stream, it may be desirable to control the relationship in the volume or gain settings between the music and the second stream.

Systems and methods for encoding and mixing multiple audio signals into a mixed stream for transmission over a channel limited link to enable decoding and separation of the audio signals from the mixed stream at a receiving playback device are described. The gains of the audio signals may be independently and dynamically controlled to allow one audio signal to be heard at a comfortable volume in the presence of another audio signal of the mixed stream. Channel encoding of the audio signals allows the audio signals to be transmitted over the channel limited link even if the aggregate channel bandwidth requirement of the individual audio signals exceeds the bandwidth of the channel limited link. The ability to separate the mixed stream into its constituent audio signals at the playback device enables the audio signals to be selectively masked, independently processed, or mixed again to provide a flexible playback environment.

For example, a host device such as a smartphone may initially encode and transmit stereo music to a playback device such as an earphone via a Bluetooth link. The bandwidth of the Bluetooth link is limited to two audio channels. As such, the stereo music may be encoded in two audio channels, one channel for each ear. When a virtual assistant response, such as one from Siri, or other types of voice notification, is received by the smartphone, the smartphone may encode and mix the virtual assistant response with the stereo music in a "barge-in" ducking process to bring the audio for the virtual assistant response to the foreground while fading the stereo music to the background. The virtual assistant response may occupy the bandwidth of one audio channel. To transmit a mixed stream of music and voice notification over the two-channel Bluetooth link, the smartphone may convert the two-channel stereo music into one channel of mono music for mixing with the one-channel virtual assistant response. The smartphone may apply independent gains to the mono music and the mono virtual assistant response before mixing the two audio signals for transmission over the two-channel Bluetooth link. The encoding and mixing of the music and the virtual assistant response allows for the decoding and separation of the music from the virtual assistant response at the playback device.

Systems and methods for decoding and separating a mixed stream into its constituent audio signals by a playback device when the mixed stream is received over a channel limited link are described. The separate audio signals have independent gains, may be independently processed and may be further mixed. In one embodiment, signal processing operations for the separately audio signals may be independently chosen to accommodate different latency requirements for the two audio signals. In one embodiment, the playback device may play all the constituent audio signals. In one embodiment, because the constituent audio signals are separate and independently processed, the playback device may mask one of audio signal when playing another audio signal.

For illustration, continuing with the example of the mixed stream of the mono music and the virtual assistant response that in the aggregate occupy two audio channels, the earphone may receive the mixed stream over the two-channel Bluetooth link from the smartphone. The mixed signal carries the music signal and the virtual assistant response, although the music signal is carried as mono music in one channel instead of the stereo image of the original music. The earphone may decode and separate the mixed stream to recover the mono music signal and the virtual assistant response signal. The earphone may apply gains to the mono music signal and the virtual assistant response, and may mix the two signals to provide two channels of audio signals, one channel for each ear. The gains for the music and the virtual assistant response may be different because the gains were independently applied at the smartphone. In addition, because the separated music signal and the virtual assistant response may be independently processed, to reduce latency, the virtual assistant response may bypass the noise suppression, frequency equalization, or other audio processing operations performed on the music signal. In the case of multiple earphones receiving the mixed stream from one smartphone, the earphones may mask the virtual assistant response at all of the earphones except for the one from which a user solicited the virtual assistant response.

In the following description, numerous specific details are set forth. However, it is understood that aspects of the disclosure here may be practiced without these specific details. In other instances, well-known circuits, structures and techniques have not been shown in detail in order not to obscure the understanding of this description.

The terminology used herein is for the purpose of describing particular aspects only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and "comprising" specify the presence of stated features, steps, operations, elements, or components, but do not preclude the presence or addition of one or more other features, steps, operations, elements, components, or groups thereof.

The terms "or" and "and/or" as used herein are to be interpreted as inclusive or meaning any one or any combination. Therefore, "A, B or C" or "A, B and/or C" mean any of the following: A; B; C; A and B; A and C; B and C; A, B and C." An exception to this definition will occur only when a combination of elements, functions, steps or acts are in some way inherently mutually exclusive.

FIG. 1 is a block diagram of a mixed stream encoding system 100 configured to encode and mix two audio signals into a mixed stream that allows the two audio signals to be decoded and separated from the mixed stream according to one embodiment of the disclosure. The mixed stream encoding system 100 may be part of a host device such as a smartphone.

A playback module 101 provides audio content, such as stereo music or a telephone call, on two channels, left bypass channel 121 and right bypass channel 123. The playback module 101 may receive the audio content from a server through a wireless network such as a cellular or WiFi network, or may provide the audio content from a local storage on the host device. The audio signals of the left bypass channel 121 and right bypass channel 123 are selected by a crossfade bypass switch 111 when the audio content from the playback module 101 is the only audio content being played. A switching signal 145 for the crossfade bypass switch 111 is provided by a notification detect module 117. The notification detect module 117 monitors for a second audio signal, such as a mono notification signal 125 received from a mono notification module 103, and when the second audio signal is absent, the notification detect module 117 commands the crossfade bypass switch 111 to select the left bypass channel 121 and the right bypass channel 123. Outputs from the crossfade bypass switch 111 are the left switched channel 139 and right switched channel 141 and are compressed or encoded by an encoder 113. In one embodiment, the encoder 113 encodes the left switched channel 139 and right switched channel 141 into the MPEG-4 advanced audio coding, enhanced low delay (AAC-ELD) format. The host device transmits the encoded audio signals to a playback device through a channel-limited wireless or wired link. In one embodiment, the smartphone may transmit the encoded stereo music to an earphone through a two-channel Bluetooth link.

While the host device transmits the encoded two-channel audio content to the playback device, the mono notification module 103 may receive a mono-channel virtual assistant response from a remote server, such as one from Siri, or other types of notifications, alerts, or audio messages. This second audio signal is output from the mono notification module 103 as the mono notification signal 125. For example, transmission of the stereo music may be interrupted by the mono-channel virtual assistant response from Siri. The mixed stream encoding system 100 may encode and mix the two-channel stereo music with the mono-channel virtual assistant response in a barge-in ducking process to bring the audio for the virtual assistant response to the foreground while fading the stereo music to the background. To transmit the mixed stream over the channel-limited link, a stereo-mono transcoder 105 converts the stereo music carried by the left bypass channel 121 and right bypass channel 123 to a mono playback signal 127. In one embodiment, the stereo-mono transcoder 105 may sum the audio contents of the left channel 121 and right channel 123 to generate the mono playback signal 127.

A playback gain module 107 applies a gain to the mono playback signal 127 to generate a gain adjusted mono playback signal 129. For the mono notification signal, a notification gain module 115 applies a gain to the mono notification signal 125 to generate a gain adjusted mono notification signal 131. The gains applied to the mono playback signal 127 and the mono notification signal 125 may be independently controlled to provide a mixed signal in which the foreground notification audio is intelligible over the background playback audio. In one embodiment, the gains may be adjustable by a user of the host device.

A playback notification mixer 109 mixes the gain adjusted mono playback signal 129 and the gain adjusted mono notification signal 131 to generate a two-channel mixed signal that includes left mixed channel 135 and right mixed channel 137. The playback notification mixer 109 mixes the two signals such that a playback device may decode and separate the two constituent signals from the two-channel mixed signal. In one embodiment, one channel of the mixed signal, for example the left mixed channel 135, may carry the sum of the gain adjusted mono playback signal 129 and the gain adjusted mono notification signal 131. The other channel of the mixed signal, for example the right mixed channel 137, may carry the difference of the gain adjusted mono playback signal 129 and the gain adjusted mono notification signal 131. To recover the gain adjusted mono notification signal 131, the playback device may sum the left mixed channel 135 and the right mixed channel 137. To recover the gain adjusted mono playback signal 129, the playback device may subtract the recovered gain adjusted mono notification signal 131 from the left mixed channel 135 or the right mixed channel 137. In one embodiment, one channel of the mixed signal may simply carry the gain adjusted mono playback signal 129 and the other channel may carry the gain adjusted mono notification signal 131. As such, the playback device may receive the gain adjusted mono playback signal 129 and the gain adjusted mono notification signal 131 as already separated signals on the two-channel mixed signal.

When the mono notification module 103 receives the virtual assistant response or other types of notification, the notification detect module 117 detects the presence of this second audio signal on the mono notification signal 125. In one embodiment, the notification detect module 117 may detect speech on the mono notification signal 125. The notification detect module 117 may command the crossfade bypass switch 111 to select the left mixed channel 135 and the right mixed channel 137 of the mixed signal as the left switched channel 139 and the right switched channel 141, respectively. The encoder module 113 encodes the left switched channel 139 and right switched channel 141 into a compressed format, such as the AAC-ELD format. The encoded audio signal may be encapsulated in audio frames. A notification frame tag module 119 generates a tag to indicate that the encoded audio frames contain a mixed signal based on the switching signal 145 for the crossfade bypass switch 111 selecting the mixed signal.

In the splitter mode when the host device transmits the mixed signal of music and virtual assistant response to multiple playback devices, the host device may determine which playback device solicits the virtual assistant response. In one embodiment, the notification frame tab module 119 may generate an indication in the audio frames to identify the playback device that solicited the virtual assistance response encapsulated in the audio frames. The playback devices may use the indication to mask the virtual assistant response except on the playback device that solicited the virtual assistance response.

The host device transmits the encoded audio frames through the channel-limited link to the playback device. Thus, when the host device receives a virtual assistant response while the host device is transmitting stereo music to the playback device over the channel-limited link, the mixed stream encoding system 100 encodes and mixes the stereo music and the virtual assistant response into a mixed stream of mono music and mono virtual assistant response such that the playback device may decode and separate the mono music and the virtual assistant response from the mixed stream.

Figure 2:
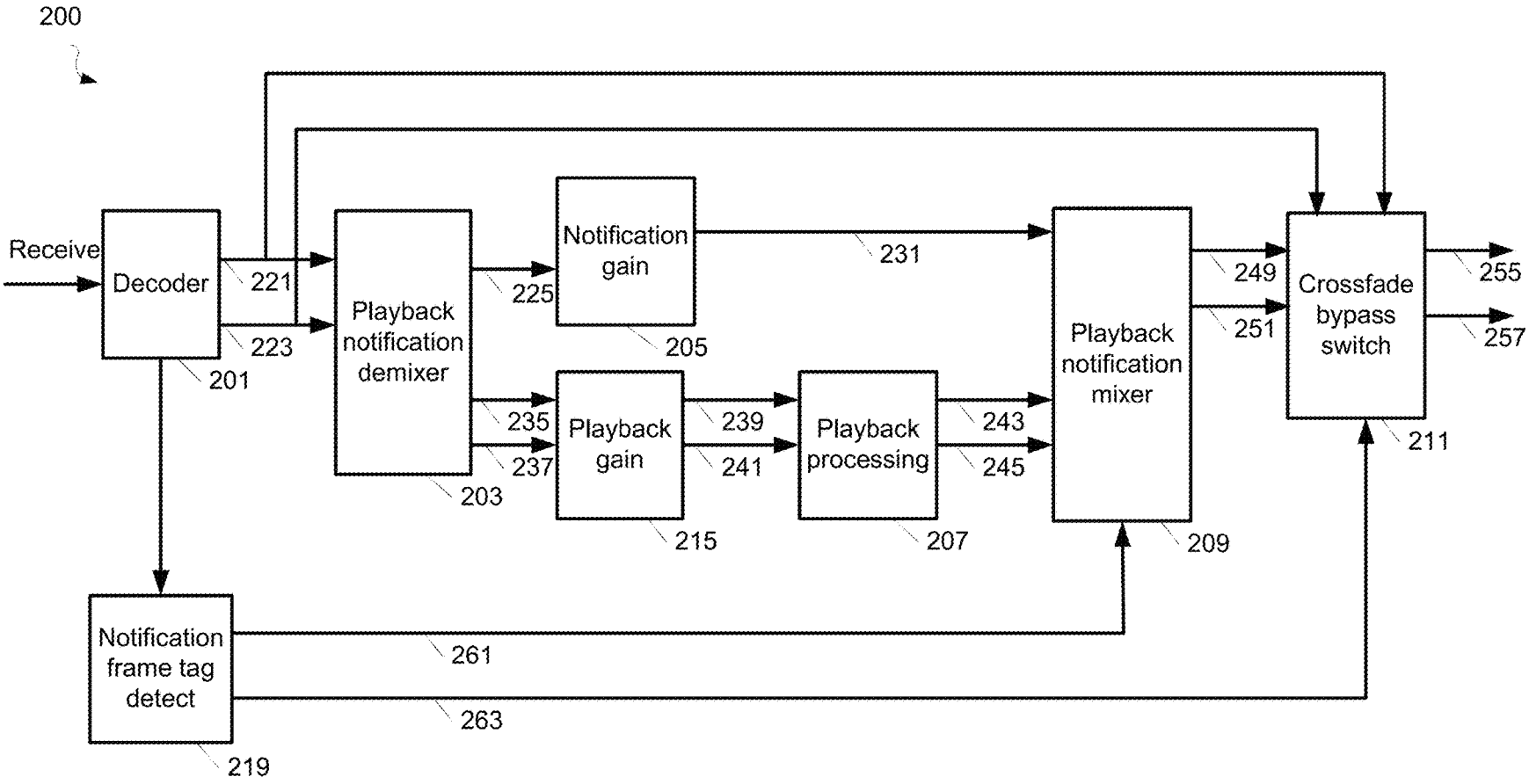
FIG. 2 is a block diagram of a mixed stream decoding system configured to decode and separate two audio signals from a mixed stream according to one embodiment of the disclosure.

FIG. 2 is a block diagram of a mixed stream decoding system 200 configured to decode and separate two audio signals from a mixed stream according to one embodiment of the disclosure. The mixed stream decoding system 200 may be part of a playback device such as an earphone.

A decoder 201 receives an encoded audio signal from the host device through the channel-limited link. The encoded audio signal may be two-channel stereo music when music playing is not interrupted by a virtual assistant response, or may be a two-channel mixed signal of mono music and mono speech signal such as a mono virtual assistant response, notification, alert, or other types of audio messages. The encoded audio signal may be encapsulated in audio frames. A tag in the audio frames may indicate that the audio frames contain a mixed signal. In one embodiment, the encoded audio signal is in the AAC-ELD format. The decoder 201 decodes the encoded audio signal into left bypass channel 221 and right bypass channel 223.

When the encoded audio signal is two-channel stereo music, a notification frame tag detect module 219 detects the absence of the mixed signal tag in the audio frames. The notification frame tag detect module 219 generates a switching signal 263 to command a crossfade bypass switch 211 to select the left bypass channel 221 and right bypass channel 223, allowing the two-channel stereo music to bypass the signal processing associated with a mixed signal. The playback device may output the two-channel stereo music through the left out channel 255 and the right out channel 257 to the left and right ears of a user.

When the encoded audio signal is a two-channel mixed signal of mono playback signal such as mono music, and mono notification signal such as a virtual assistant response, a playback notification de-mixer 203 decodes and separates the mixed signal into a decoded notification signal 225 and a pair of decoded playback channels, left decoded playback channel 235 and right decoded playback channel 237. In one embodiment, one channel of the mixed signal may carry the sum of the mono music playback signal and the mono notification signal. The other channel of the mixed signal may carry the difference of the mono music playback signal and the mono notification signal. To recover the mono notification signal from the mixed signal, the playback notification de-mixer 203 may sum the left bypass channel 221 and right bypass channel 223 to generate the decoded notification signal 225. To recover the mono music playback signal, the playback notification de-mixer 203 may subtract the recovered mono notification signal from the left bypass channel 221 and the right bypass channel 223 to generate the left decoded playback channel 235 and right decoded playback channel 237. The left decoded playback channel 235 and the right decoded playback channel 237 may be offset in phase by 180°.

In one embodiment, one channel of the mixed signal may carry the mono music playback signal and the other channel may carry the mono notification signal. The playback notification de-mixer 203 may route the left bypass channel 221 or the right bypass channel 223 carrying the mono notification signal to the decoded notification signal 225. The playback notification de-mixer 203 may route the left bypass channel 221 or the right bypass channel 223 carrying the mono music playback signal to the left decoded playback channel 235. The right decoded playback channel 237 may be generated from the left decoded playback channel 235 by offsetting the phase of the left decoded playback channel 235 by 180°.

Thus, the mono music playback signal and the mono notification signal are separated from the received mixed signal. The gain, processing latency, or masking capability of the mono music playback signal and the mono notification signal may be independently controlled to provide enhanced flexibility for the two signals. For example, a notification gain module 205 applies a gain to the decoded notification signal 225 to generate a gain adjusted decoded notification signal 231. A playback gain module 215 applies a gain to the left decoded playback channel 235 and the right decoded playback channel 237 to generate left and right gain adjusted decoded playback channels 239 and 241. The gains for the music playback signal and the notification signal may be independently controlled.

The music playback signal and the notification signal may also have different processing requirements. For example, while the notification signal may be relatively clean, the music playback signal may need further processing to enhance its sound quality. A playback processing module 207 processes the left and right gain adjusted decoded playback channels 239 and 241 to perform signal processing such as noise suppression, frequency equalization, or other audio processing operations to generate left and right processed playback channels 243 and 245. In one embodiment, the playback processing module 207 may mitigate the loss of stereo quality in the mono music playback signal by performing simple to complex pseudo-stereo enhancement processing. Because the notification signal bypasses the playback processing module 207, the signal path of the notification signal is different from the signal path of the music playback signal, and the latency of the notification signal path may be reduced relative to that of the music playback signal path.

After the notification signal and the playback signal have been independently gain adjusted and processed, they may be mixed back into a two-channel audio signal. For example, playback notification mixer 209 may mix the gain adjusted decoded notification signal 231 and the left and right processed playback channels 243 and 245 to generate a two-channel remixed signal that includes left remixed decoded signal 249 and right remixed decoded signal 251.

When the encoded audio signal received by the playback device is a mixed signal, the notification frame tag detect module 219 detects the mixed signal tag in the audio frames. The notification frame tag detect module 219 generates the switch signal 263 to command the crossfade bypass switch 211 to select the left remixed decoded signal 249 and right remixed decoded signal 251 for output to the left out channel 255 and right out channel 257.

In one embodiment, the playback device may mask the notification signal and may only play the music playback signal even though a mixed signal is received. For example, in the splitter mode when a host device transmits a mixed stream of music and virtual assistant response to multiple playback devices, the virtual assistant response may be masked to all playback devices except for the playback device from which a user solicited the virtual assistant response.

Figure 3:
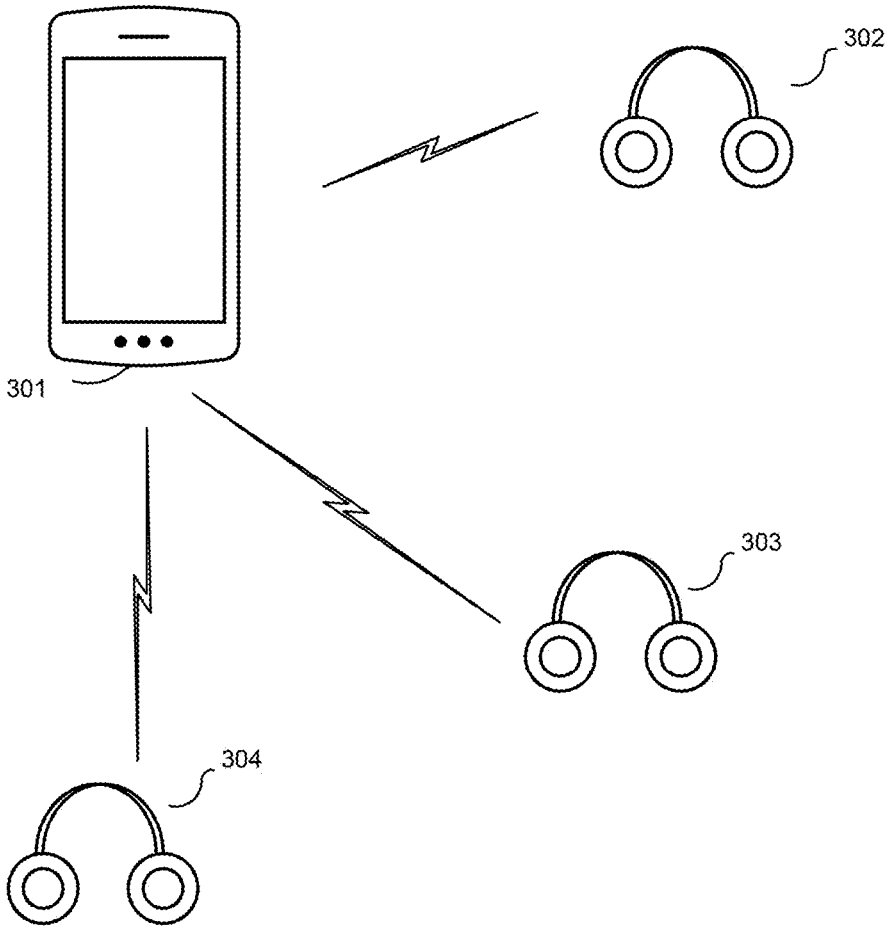
FIG. 3 depicts a scenario in which a host device transmits a mixed stream of audio signals to multiple playback devices where the audio signals may be selectively enabled on one of the playback devices according to one embodiment of the disclosure.

FIG. 3 depicts a scenario in which a host device 301 transmits a mixed stream of audio signals to multiple playback devices where the audio signals may be selectively enabled on one of the playback devices according to one embodiment of the disclosure. The playback devices are earphones 302, 303, and 304. A user wearing the earphone 302 may solicit a virtual assistant response. While the source device 301 transmits a mixed signal of music and virtual assistant response to all three earphones 302, 303, and 304, it is desirable that only the user of earphone 302 hears the virtual assistant response. In one embodiment, earphone 302 recognizes that it was used to solicit the virtual assistant response and the earphone 302 lets through the decoded mixed signal to the output. On the other hand, earphones 303 and 304 do not recognize that they were used to solicit the virtual assistant response and may mask out the virtual assistant response to play only the music from the mixed signal. In one embodiment, the host device 301 may recognize that earphone 302 solicited the virtual assistant response and may transmit an indication in the encoded audio frames of mixed signal to indicate that only earphone 302 is enabled to play or to mask the virtual assistant response. In other embodiments, the playback device used to solicit the virtual assistant response may not be the same as the playback device on which the virtual assistant response is played.

Referring back to FIG. 2, the notification frame tag detect module 219 may generate a notification privacy setting signal 261 to the playback notification mixer 209. In one embodiment, the notification privacy setting signal 261 indicates whether the mixed stream decoding system 200 is configured to mask out the notification signal, such as when the playback device was not used to solicit the notification signal. In one embodiment, the notification frame tag detect module 219 may decode the notification privacy setting signal 261 based on an indication in the audio frames containing the mixed signal received from the host device. The host device may transmit the indication to indicate which playback device is configured to play the notification signal, whether it is the playback device used to solicit the notification signal or a different playback device. In one embodiment, a playback device may determine the notification privacy setting signal 261 without relying on the host device based on the knowledge that the playback device solicited the notification signal. When the notification signal is to be masked out, the playback notification mixer 209 may select the left and right processed playback channels 243 and 245 as the left remixed decoded signal 249 and right remixed decoded signal 251, thus masking the gain adjusted decoded notification signal 231 from the output.

Figure 4:
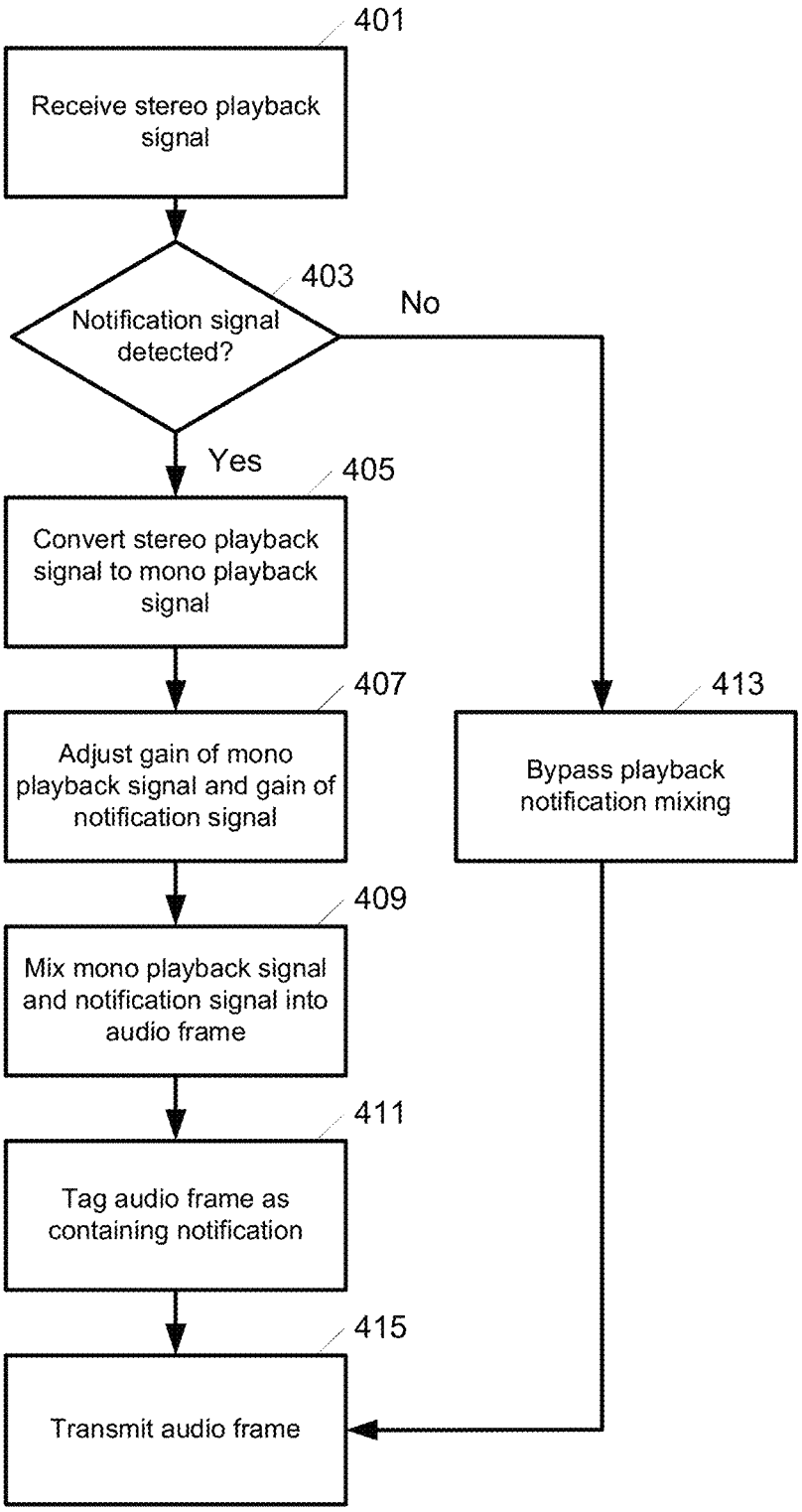
FIG. 4 is a flow diagram of a method of encoding and mixing two audio signals into a mixed stream that allows the two audio signals to be decoded and separated in accordance to one embodiment of the disclosure.

FIG. 4 is a flow diagram of a method of encoding and mixing two audio signals into a mixed stream that allows the two audio signals to be decoded and separated in accordance to one embodiment of the disclosure. The method may be practiced by the mixed stream encoding system 100 of the host device of FIG. 1. Even though the method is illustrated using a stereo playback signal carried on two channels and a second audio signal carried on a single channel, the method also applies to a stereo playback signal carried on more than two channels, a second audio signal carried as a stereo signal, or to encoding and mixing more than two audio signals into a mixed stream.

In operation 401, the method receives stereo playback, such as stereo music on two or more audio channels. The stereo playback may be received from a server device through a wireless or wired network, or may be sourced locally from the host device.

In operation 403, the method determines if a second audio signal, collectively referred to as a notification, is received. The notification may be carried on a single channel and may include a virtual assistant response from a remote server, an alert, an audio message, a voice response, etc. The notification may be received from a server through a wireless or wired network. A speech recognition algorithm may detect the notification.

If a notification is not received, then the stereo playback is the only audio signal. In operation 413, the method bypasses the operation for mixing the stereo playback and the notification and selects the stereo playback for transmission to a playback device. The stereo playback may be encoded or compressed for transmission through a channel-limited wireless or wired link.

If a notification is received, the method may mix and encode the stereo playback and the notification in a barge-in ducking process. In operation 405, the method converts the stereo playback to a mono playback signal. In one embodiment, operation 405 may sum the contents of the two or more channels of the stereo playback to generate the mono playback signal. In one embodiment, if the stereo playback has more than two channels, the operation 405 may process the contents of the stereo playback to generate a playback signal with a reduced number of channels.

In operation 407, the method applies a gain to the mono playback signal and a gain to the notification. The gain applied to the mono playback signal and the gain applied to the notification may be independently controlled so that when the two signals are mixed the notification audio is in the foreground and is intelligible over the background playback audio. In one embodiment, the gains may be adjustable by a user of the host device.

In operation 409, the method mixes the gain adjusted mono playback signal and the gain adjusted notification to generate a mixed signal that allows the playback signal and the notification to be decoded and separated from the mixed signal at a playback device. In one embodiment, one channel of the mixed signal may carry the sum of the gain adjusted mono playback signal and the gain adjusted notification. The other channel of the mixed signal may carry the difference of the gain adjusted mono playback signal and the gain adjusted notification. In one embodiment, one channel of the mixed signal may carry the gain adjusted mono playback signal and the other channel may carry the gain adjusted notification. The mixed signal may be encoded or compressed and encapsulated into audio frames.

In operation 411, the method tags the audio frames as containing a mixed signal. A playback device may detect the tag to enable operations that de-mix and separate the mixed signal encapsulated in the audio frames into the constituent playback signal and the notification. In one embodiment, when in the splitter mode where the host device transmits the mixed signal to multiple playback devices, the method may determine which playback device solicits the notification. The method may tag the audio frames with an indication to identify the playback devices that solicits the notification so that playback devices that did not solicit the notification may mask the notification.

In operation 415, the method transmits the mixed signal when the notification is present, or the stereo playback when the notification is absent, to one or more playback devices through a channel-limited wireless or wired link. In one embodiment, the channel-limited wireless link may be a two-channel Bluetooth link. The mixed signal or the stereo playback may be transmitted on the two audio channels of the Bluetooth link.

Figure 5:
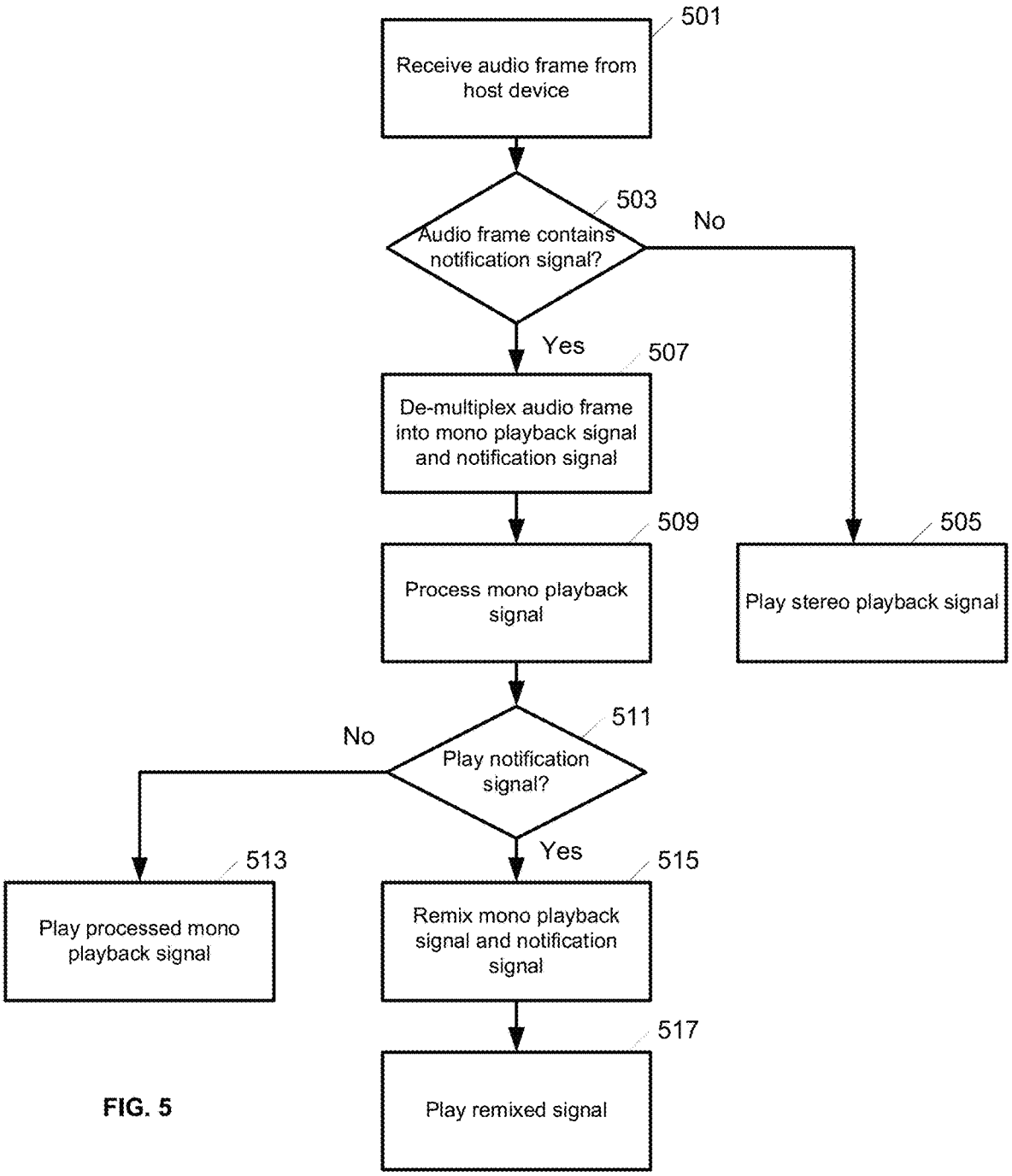
FIG. 5 is a flow diagram of a method of decoding and separating two audio signals from a mixed stream that may be practiced by a playback device in accordance to one embodiment of the disclosure.

FIG. 5 is a flow diagram of a method of decoding and separating two audio signals from a mixed stream that may be practiced by a playback device in accordance to one embodiment of the disclosure. Even though the method is illustrated using a two-channel mixed signal of music playback and speech signal of a notification, the method applies to a mixed signal of more than two audio signals or to a mixed signal carried on more than two channels.

In operation 501, the method receives one or more audio frames from a host device over a channel-limited wireless or wired link. The audio frames may contain a two-channel stereo playback signal when the notification is absent, or a mixed signal of mono playback signal and mono speech signal when the notification is present. The audio signal may be encoded and encapsulated in the audio frames. The method may extract and decode the audio signal.

In operation 503, the method determines if the audio signal is a mixed signal by detecting if the audio frames contain a mixed-signal tag. The mixed-signal tag may be transmitted by the host device to indicate that notification is present. The method may use the mixed-signal tag to enable operations that de-mix and separate the mixed signal into the constituent playback signal and the notification.

If the mixed-signal tag indicates that the notification is absent, the audio signal is a stereo playback signal and may bypass the de-mixing and other operations performed on a mixed signal. In operation 505, the method outputs the stereo playback signal as an output of the playback device.

If the mixed-signal tag indicates the presence of the notification, the audio signal is a mixed signal of mono playback signal and mono speech signal containing the notification. In operation 507, the method de-mixes or de-multiplexes the mixed signal into the mono playback signal and the notification. In one embodiment, one channel of the mixed signal may carry the sum of the mono playback signal and the notification and the other channel of the mixed signal may carry the difference of the mono playback signal and the notification. Operation 507 may sum the two channels of the mixed signal to recover the notification. Operation 507 may subtract the recovered notification from the two channels of the mixed signal to recover the mono playback as a two-channel signal. The recovered two-channel mono playback signals may be offset in phase by 180°. In one embodiment, one channel of the mixed signal may carry the mono playback signal and the other channel may carry the notification. Operation 507 may de-multiplex the mixed signal to recover the notification and the mono playback signal. The recovered mono playback signal may be inverted to generate the two-channel mono playback signals offset in phase by 180°.

In operation 509, the method processes the two-channel mono playback signals. The processing may include operations such as gain adjustment, noise suppression, frequency equalization or other audio processing operations. In one embodiment, operation 509 may perform pseudo-stereo enhancement on the mono playback signal.

In operation 511, the method determines whether to play the notification. For example, in the splitter mode in which multiple playback devices receive the mixed signal from the host device, it may be desirable to play the notification only on the playback device that solicited the notification. In one embodiment, operation 511 determines if the received audio frames include an indication that identifies the playback device as one enabled by the host device to play the notification. In one embodiment, operation 511 may record a history of the solicitations from the playback device for notifications and may recognize that a notification is received in response to the solicitations.

In operation 513, if the notification is not to be played, the method masks the notification and plays only the two-channel mono playback signals. For example, if the playback device did not solicit the notification in the splitter mode, the playback device does not play the notification to protect the privacy of the user who solicited the notification using another playback device.

In operation 515, if the notification is to be played, the method mixes the two-channel mono playback signals and the notification to generate a two-channel remixed signal. In one embodiment, operation 515 may adjust the gain of the notification so that the notification is in the foreground and is intelligible over the background playback signals.

In operation 517, the method outputs the remixed signal as an output of the playback device. In one embodiment, if the playback device is an earphone, operation 517 may output a respective channel of the two-channel remixed signal to the right and the left ears of the user.

While certain exemplary instances have been described and shown in the accompanying drawings, it is to be understood that these are merely illustrative of and not restrictive on the broad invention, and that this invention is not limited to the specific constructions and arrangements shown and described, since various other modifications may occur to those of ordinary skill in the art. The description is thus to be regarded as illustrative instead of limiting.

To aid the Patent Office and any readers of any patent issued on this application in interpreting the claims appended hereto, applicant wishes to note that it is not intended for any of the appended claims or claim elements to invoke 35 U.S.C. 112(f) unless the words "means for" or "step for" are explicitly used in the particular claim.

What is claimed is:

1. A method of mixing a plurality of audio signals on an audio source device, the method comprising:

receiving a playback audio signal carried on a plurality of audio channels;

determining whether a notification audio signal is received;

in response to determining that the notification audio signal is received, converting the playback audio signal into a converted playback audio signal that is carried on one or more audio channels being fewer in number than the plurality of audio channels;

applying different gains to the converted playback audio signal and the notification audio signal;

mixing the gain-applied converted playback audio signal and the gain-applied notification audio signal into a mixed audio signal; and in response to determining that the notification audio signal is received, selecting the mixed audio signal instead of the playback audio signal to send over a communication link.

2. The method of claim 1, wherein the mixed audio signal allows the gain-applied converted playback audio signal and the gain-applied notification audio signal to be separated from the mixed audio signal at an audio playback device, and wherein the mixed audio signal is capable of being carried on a same number of audio channels as the plurality of audio channels used to carry the playback audio signal.

3. The method of claim 1, wherein the communication link is a channel limited link that supports a transmission of audio signals carried on no more than the plurality of audio channels.

4. The method of claim 1, wherein the playback audio signal comprises stereo music carried on two audio channels.

5. The method of claim 4, wherein converting the playback audio signal into the converted playback audio signal comprises converting the stereo music carried on the two audio channels into mono music carried on one audio channel.

6. The method of claim 1, wherein the notification audio signal comprises a speech signal carried on one audio channel.

7. The method of claim 1, wherein applying different gains to the converted playback audio signal and the notification audio signal comprises ducking a volume of the converted playback audio signal under a volume of the notification audio signal.

8. The method of claim 1, further comprising:

in response to determining that the notification audio signal is received, encoding the mixed audio signal into one or more audio frames;

in response to determining the notification audio signal is not received, encoding the playback audio signal into one or more audio frames; and transmitting by the audio source device the audio frames to one or more audio playback devices.

9. The method of claim 8, further comprising:

in response to determining that the notification audio signal is received, tagging the audio frames to indicate that the audio frames contain the mixed audio signal.

10. The method of claim 8, further comprising:

receiving the notification audio signal in response to a request from one of the one or more audio playback devices; and tagging the audio frames with identification information to identify the one audio playback device that requested the notification audio signal.

11. A method of decoding a plurality of audio signals on an audio playback device, the method comprising:

receiving one or more audio frames from an audio source device over a communication link;

determining that the audio frames contain a mixed audio signal, wherein the mixed audio signal includes a converted playback audio signal and a notification audio signal having different gains, and wherein the converted playback audio signal is generated from a playback audio signal;

separating the mixed audio signal into the converted playback audio signal and the notification audio signal;

remixing the converted playback audio signal and the notification audio signal to generate a remixed audio signal; and playing back the remixed audio signal.

12. The method of claim 11, further comprising:

determining that the audio frames contain the playback audio signal; and playing back the playback audio signal, wherein the audio frames containing the playback audio signal or the audio frames containing the mixed audio signal are received using a same number of audio channels over the communication link.

13. The method of claim 11, wherein the playback audio signal comprises stereo music carried on two audio channels.

14. The method of claim 13, wherein the converted playback audio signal comprises the stereo music of the playback audio signal carried on the two audio channels being converted into mono music carried on one audio channel.

15. The method of claim 11, wherein the notification audio signal comprises a speech signal carried on one audio channel.

16. The method of claim 11, further comprising:

requesting by the playback audio device the notification audio signal.

17. The method of claim 11, wherein determining that the audio frames contain the mixed audio signal comprises:

detecting a tag in the audio frames, wherein the tag indicates that the audio frames contain the mixed audio signal.

18. The method of claim 11, wherein remixing the converted playback audio signal and the notification audio signal to generate the remixed audio signal comprises:

processing the converted playback audio signal on a separate path from that of the notification audio signal to provide separate path latencies for the converted playback audio signal and the notification audio signal.

19. The method of claim 18, further comprising:

determining whether to play the notification audio signal; and in response to determining to play the notification audio signal, playing the remixed audio signal.

20. The method of claim 18, further comprising:

determining whether to play the notification audio signal; and in response to determining not to play the notification audio signal, playing the processed converted playback audio signal.

* * * * *